US007849837B2

(12) United States Patent
Hasebe et al.

(10) Patent No.: US 7,849,837 B2
(45) Date of Patent: Dec. 14, 2010

(54) VAPORIZED FUEL PROCESSING DEVICE IN WORK MACHINE

(75) Inventors: Hiroaki Hasebe, Wako (JP); Yasunori Matsubara, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/481,625

(22) Filed: Jun. 10, 2009

(65) Prior Publication Data

US 2009/0314261 A1 Dec. 24, 2009

(30) Foreign Application Priority Data

Jun. 20, 2008 (JP) ..... 2008-161744

(51) Int. Cl.
*F02M 37/20* (2006.01)
*F02M 33/02* (2006.01)
*F02B 77/04* (2006.01)

(52) U.S. Cl. ..... 123/516; 123/518; 123/198 E

(58) Field of Classification Search ..... 123/516, 123/518, 519, 520, 198 E
See application file for complete search history.

(56) References Cited

U.S. PATENT DOCUMENTS 3,554,175 A * 1/1971 Sarto ..... 123/519
3,575,152 A * 4/1971 Wentworth ..... 123/520
3,618,578 A * 11/1971 Swatman et al. ..... 123/519
3,646,731 A * 3/1972 Hansen ..... 96/136
3,675,634 A * 7/1972 Tatsutomi et al. ..... 123/519
3,683,597 A * 8/1972 Beveridge et al. ..... 123/519
3,696,799 A * 10/1972 Gauck ..... 123/518
3,854,911 A * 12/1974 Walker ..... 96/144
4,000,727 A * 1/1977 Walker ..... 123/519
4,085,721 A * 4/1978 Vardi et al. ..... 123/520
4,212,276 A * 7/1980 Kaneda ..... 123/519
4,308,842 A * 1/1982 Watanabe et al. ..... 123/520
4,446,838 A * 5/1984 Suzuki et al. ..... 123/520
5,103,794 A * 4/1992 Shiraishi ..... 123/520
5,347,971 A * 9/1994 Kobayashi et al. ..... 123/520

* cited by examiner

*Primary Examiner*—Thomas N Moulis
(74) *Attorney, Agent, or Firm*—Westerman, Hattori, Daniels & Adrian, LLP

(57) ABSTRACT

In an working machine in which: an engine and a fuel tank for the engine are mounted on a machine body; an air cleaner mounted outside the machine body has a cleaner case including a cylindrical case body and a lid body being mounted on one end of the case body, and a cleaner element being housed in the cleaner case and dividing the inside of the cleaner case into a pre-purification chamber and a post-purification chamber; and an air-outlet pipe is connected to an intake system of the engine with an intake duct interposed therebetween, a canister capable of absorbing a vaporized fuel generated in the fuel tank is attached to the fuel tank or the machine body; a purge joint communicating with the post-purification chamber is provided to the lid body of the air cleaner; and a purge conduit extending from the canister is connected to the purge joint. Accordingly, it is possible to take a vaporized fuel generated in the fuel tank into the engine by utilizing the lid body of the air cleaner.

7 Claims, 3 Drawing Sheets

VAPORIZED FUEL PROCESSING DEVICE IN WORK MACHINE

CROSS-REFERENCE TO RELATED APPLICATIONS

The present invention claims priority under 35 USC §119 based on Japanese patent application No. 2008-161744 filed 20 Jun. 2008. The subject matter of this priority document is incorporated by reference herein.

FIELD OF THE INVENTION

The present invention relates to a vaporized fuel processing device in a work machine such as engine-drive-type tillers and mowers for farming gardening use and generators, and especially relates to a vaporized fuel processing device in a work machine in which an engine and a fuel tank for the engine are mounted on a machine body, an air cleaner is mounted outside the machine body, the air cleaner comprises a cleaner case and a cleaner element, the cleaner case including a cylindrical case body and a lid body, the case body including an air-inlet pipe on an outer periphery thereof and an air-outlet pipe at one of opposite ends thereof and having the other end thereof open, the lid body being mounted on the other end of the case body, the cleaner element being housed in the cleaner case and dividing the inside of the cleaner case into a pre-purification chamber communicating with the air-inlet pipe and a post-purification chamber communicating with the air-outlet pipe, and the air-outlet pipe is connected to an intake system of the engine with an intake duct interposed therebetween.

DESCRIPTION OF THE RELATED ART

In the case of a work machine, such as a riding-type mower, to be operated under environments with a large amount of dust, a generally-employed air cleaner that is installed inside an engine room has a short service life because the clogging of dust is likely to occur in the air cleaner. In this respect, a conventional approach to solve the problem is that a large-sized air cleaner is set at a position outside the machine body where the amount of dust is relatively small, and air filtered by the air cleaner is taken into the engine in the engine room. However, the fact is that this approach does not consider at all the processing of a vaporized fuel generated in the fuel tank.

SUMMARY OF THE INVENTION

The present invention has been made in view of the above-described circumstances. An object of the present invention is thus to provide a vaporized fuel processing device in a work machine, the vaporized fuel processing device taking a vaporized fuel generated in a fuel tank into an engine by utilizing a lid body of the air cleaner so as to be capable of contributing to a reduction in emissions.

In order to achieve the object, according to a feature of the present invention, there is provided a vaporized fuel processing device in a work machine in which an engine and a fuel tank for the engine are mounted on a machine body, an air cleaner is mounted outside the machine body, the air cleaner comprises a cleaner case and a cleaner element, the cleaner case including a cylindrical case body and a lid body, the case body including an air-inlet pipe on an outer periphery thereof and an air-outlet pipe at one of opposite ends thereof and having the other end thereof open, the lid body being mounted on the other end of the case body, the cleaner element being housed in the cleaner case and dividing the inside of the cleaner case into a pre-purification chamber communicating with the air-inlet pipe and a post-purification chamber communicating with the air-outlet pipe, and the air-outlet pipe is connected to an intake system of the engine with an intake duct interposed therebetween, the vaporized fuel processing device comprising: a canister which is attached to one of the fuel tank and the machine body and is capable of absorbing a vaporized fuel generated in the fuel tank; a purge joint which is provided to the lid body of the air cleaner and communicates with the post-purification chamber; and a purge conduit which extends from the canister and is connected to the purge joint.

According to the feature of the present invention, the purge joint for connection of the purge conduit is provided to the portion, facing the post-purification chamber, of the lid body of the air cleaner. Accordingly, processing the vaporized fuel removed from the canister is enabled only by performing a quite small number of processes, that is, by attaching the purge joint to the lid body of the conventional air cleaner. As a result, the vaporized fuel processing device can be provided at a low cost. In addition, it goes without saying that the clogging of dust is unlikely to occur in the purge joint provided to the portion, facing the post-purification chamber, of the lid body. Even if such clogging occurs, the purge joint can be easily cleaned up from the inner side thereof only by detaching the lid body.

The working machine corresponds to a riding-type mower 10 of an embodiment of the present invention which will be explained below, and the machine body corresponds to a vehicle-body frame 11 and an engine hood 30.

The above description, other objects, characteristics and advantages of the present invention will be clear from detailed descriptions which will be provided for the preferred embodiment referring to the attached drawings.

DESCRIPTION OF THE PREFERRED EMBODIMENT

An embodiment of the present invention will be described below based on the attached drawings.

Figure 1:
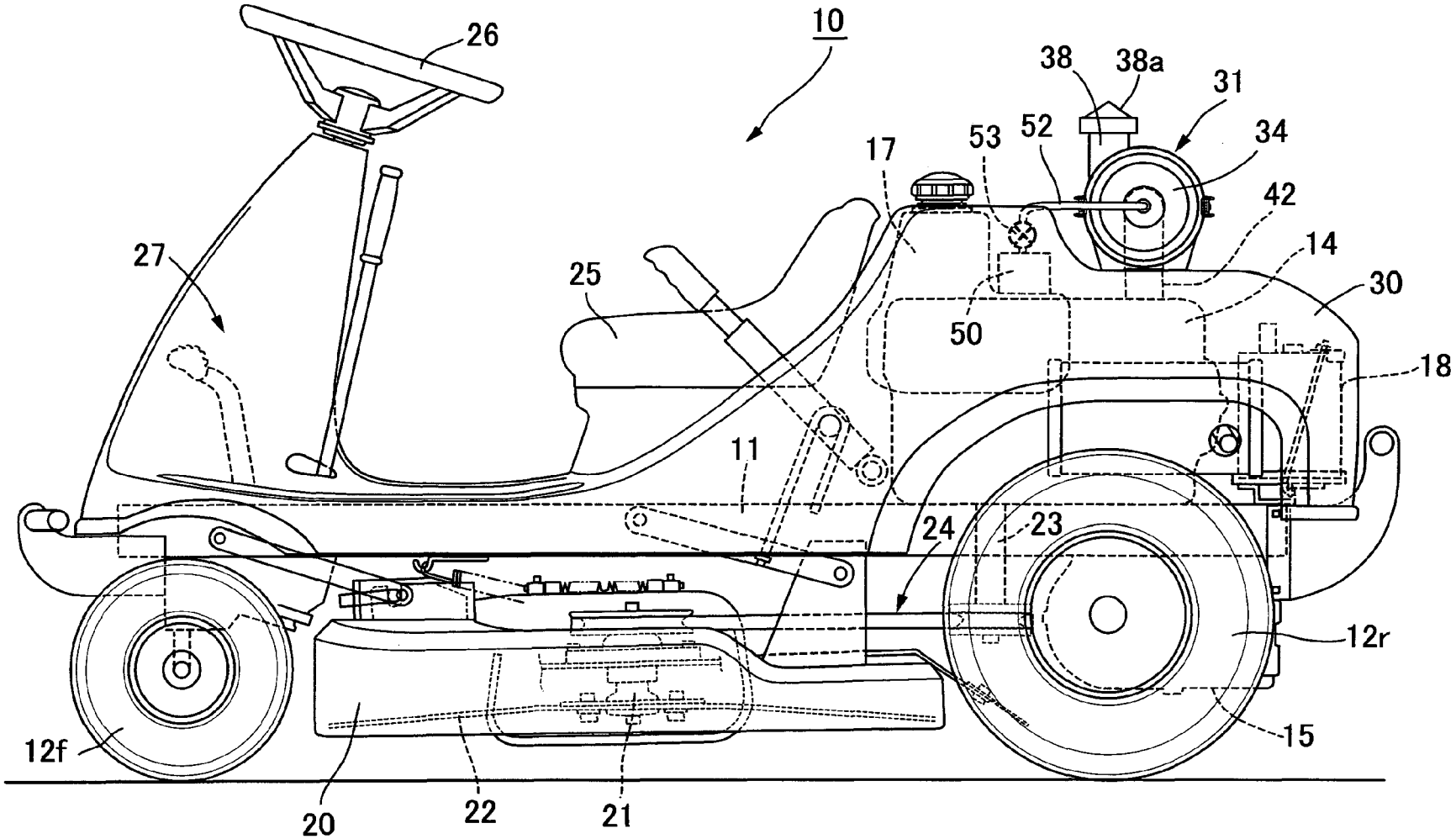
FIG. 1 is a side view of a riding-type mower equipped with a vaporized fuel processing device of the present invention.
Figure 2:
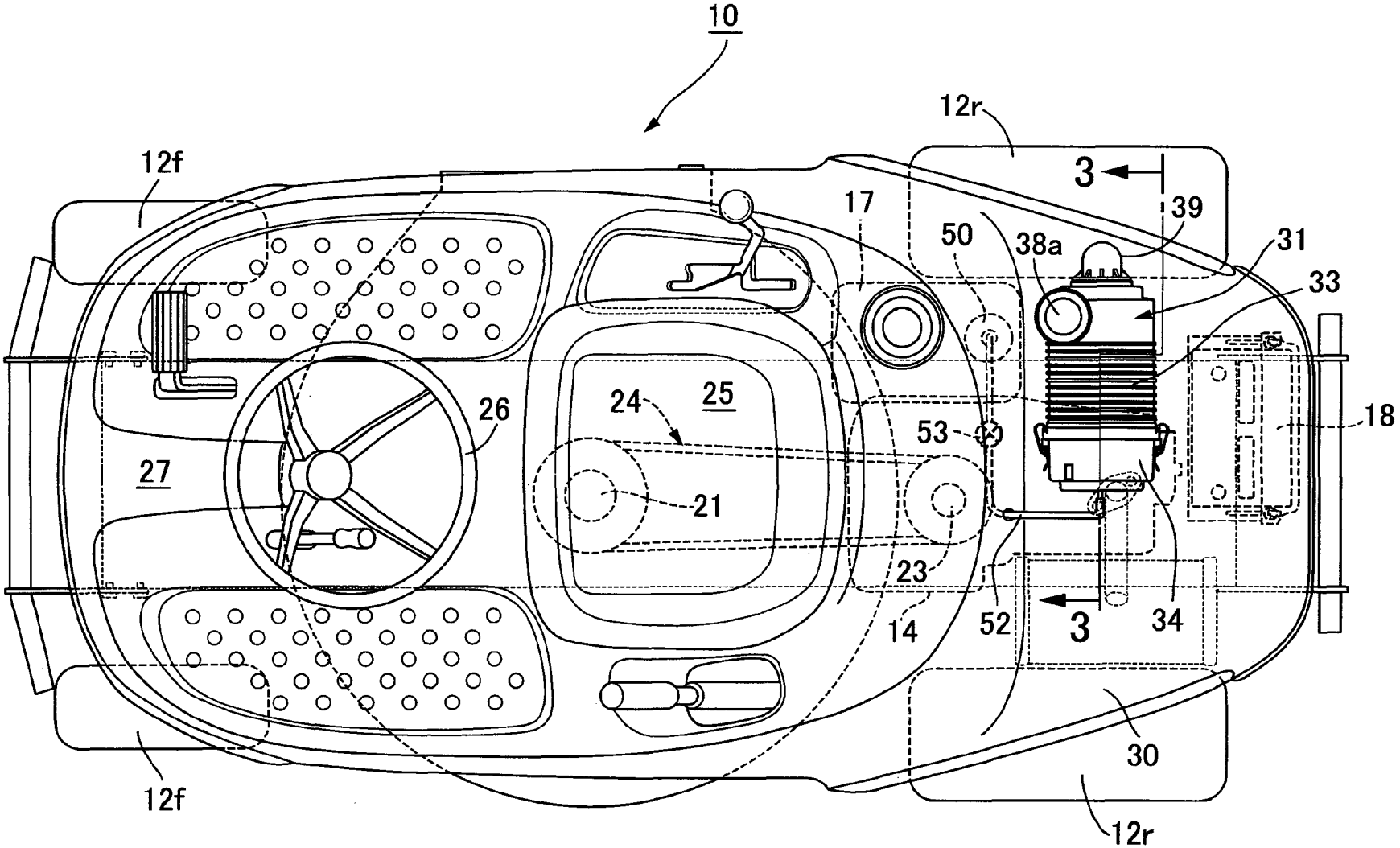
FIG. 2 is a plan view of the riding-type mower.

This embodiment shows a riding-type mower to which the present invention is applied. At first, in FIGS. 1 and 2, a riding-type mower 10 includes a vehicle-body frame 11 that is long in the front-rear direction. A pair of front wheels 12*f*, 12*f* are steerably suspended on a front portion of the vehicle-body frame 11. In addition, an engine 14 and a transmission 15, which is provided continuously from the engine 14, are mounted on a rear portion of the vehicle-body frame 11. Rear wheels 12*r*, 12*r* are rotatably supported in axle housings (not illustrated) continuously provided respectively on the left and right sides of the transmission 15, so that the rear wheels 12*r*, 12*r* are driven by the output from the transmission 15.

A fuel tank 17 is attached to one side of the engine 14, and a battery 18 is fixed to the vehicle-body frame 11 behind the engine 14.

A cutter housing 20 is arranged between the front wheels 12*f*, 12*f* and the rear wheels 12*r*, 12*r*, below the vehicle-body frame 11. The cutter housing 20 has a saucer-like shape having an opening at its lower side, and is connected to the vehicle-body frame 11 in such a manner as to be adjustable in height by being lifted and lowered. The cutter housing 20 supports a vertically extending cutter driving shaft 21 at a center portion of the cutter housing 20, and houses a cutter 22 connected to a lower end of the cutter driving shaft 21.

On the other hand, the engine 14 includes a power take-off shaft 23 vertically protruding below from a front portion of the engine 14. The power take-off shaft 23 is linked to the cutter driving shaft 21 with a belt-transmission system 24 therebetween. With this structure, the riding-type mower 10, when driven at a very low speed, drives the cutter driving shaft 21 by the rotation of the power take-off shaft 23 via the belt-transmission system 24 to rotate the cutter 22, so that the mowing operation is performed.

Moreover, a riding seat 25 is mounted on the vehicle-body frame 11 in front of the engine 14, and a steering system 27 including a steering wheel 26 is disposed in front of the riding seat 25.

Furthermore, an engine hood 30, which covers almost entirely the engine 14, the transmission 15, and the fuel tank 17, is detachably attached to the vehicle-body frame 11, and a cylindrical large-sized air cleaner 31 for filtering an air to be taken into the engine 14 is mounted on an upper surface of the engine hood 30.

Figure 3:
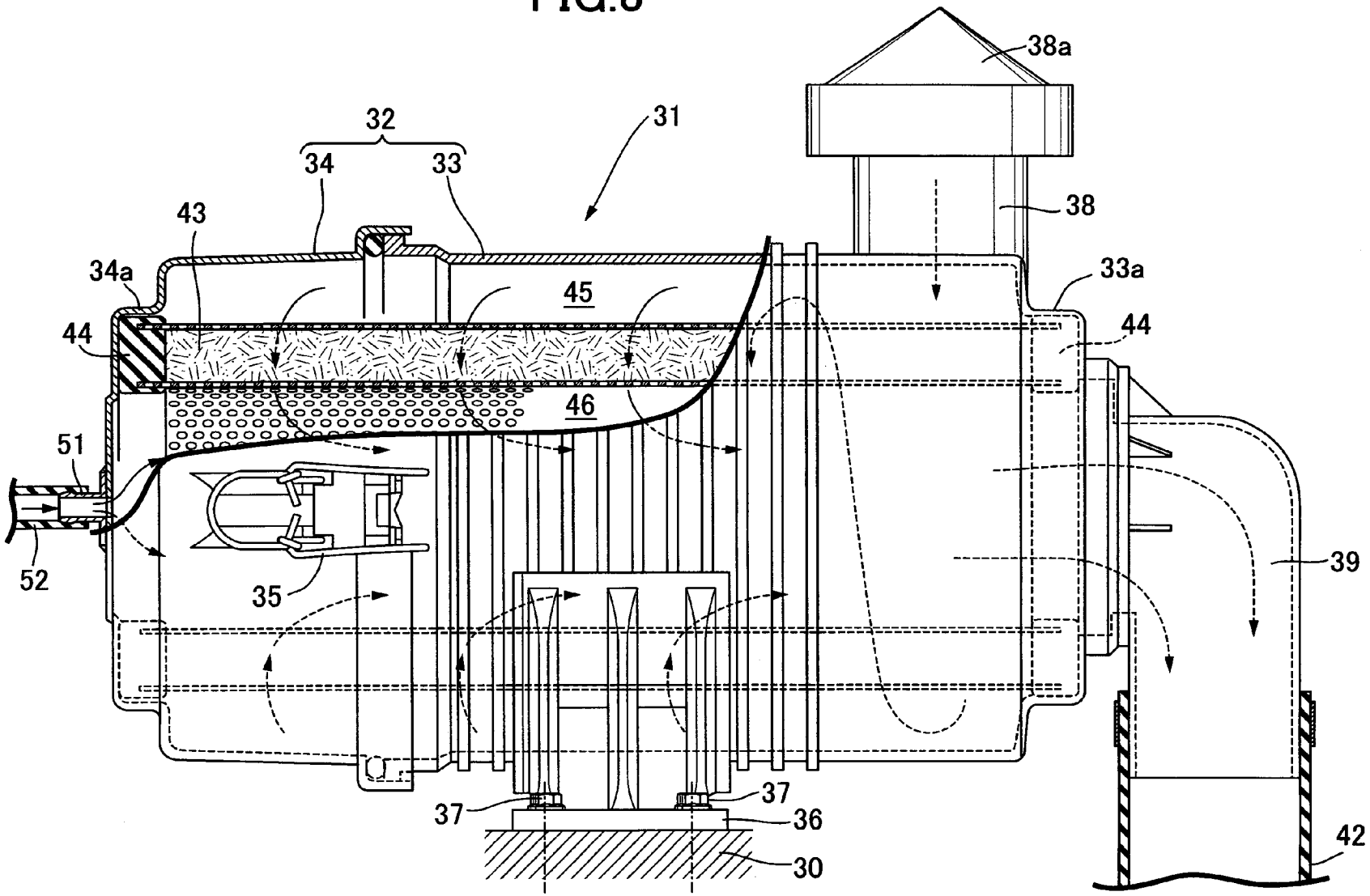
FIG. 3 is an enlarged cross-sectional view taken along a line 3-3 in FIG. 2.

As illustrated in FIG. 3, a cleaner case 32 of the air cleaner 31 is constituted of a case body 33 and a lid body 34. The case body 33 has a cylindrical shape with an opening end, and the lid body 34 is detachably attached to the opening end of the case body 33 and is fixed thereto by a locking member 35. The case body 33 includes a mounting flange 36 formed in a lower portion of the case body 33, and the mounting flange 36 is fixed to the engine hood 30 with a plurality of bolts 37, 37. In addition, the case body 33 includes an air-inlet pipe 38 protruding upward along a tangential direction of the outer periphery of the case body 33, and is provided with an air-outlet pipe 39 on an end portion of the case body 33 on the opposite side to the lid body 34. An umbrella-shaped cover 38*a* for keeping out rainwater is attached to an upper end of the air-inlet pipe 38. The air-outlet pipe 39 is connected to an inlet of an intake passage of an intake system, that is, a carburetor or a throttle body (not illustrated), of the engine 14 with an intake duct 42 provided therebetween.

A cylindrical cleaner element 43 is housed in the cleaner case 32. The cleaner element 43 is provided with a pair of annular seal members 44, 44 attached respectively to opposite ends of the cleaner element 43 in the longitudinal direction thereof. A first supporting portion 33*a* having a shallow cylindrical shape with a small diameter is formed in an end wall of the case body 33, and a second supporting portion 34*a* also having a shallow cylindrical shape with a small diameter is formed in an end wall of the lid body 34. The cleaner element 43 is held between the case body 33 and the lid body 34 with the pair of annular seal members 44, 44 being tightly fitted into the inner peripheral surfaces of the first and second supporting portions 33*a* and 34*a*.

The inside of the cleaner case 32 is divided by the cleaner element 43 into a pre-purification chamber 45 and a post-purification chamber 46. The pre-purification chamber 45 communicates with the air inlet pipe 38 and the post-purification chamber 46 communicates with the air outlet pipe 39. A purge joint 51 opening to the post-purification chamber 46 is welded to the lid body 34.

On the other hand, a canister 50 communicating with an upper space inside the fuel tank 17 is mounted on the fuel tank 17. The canister 50 is one like those conventionally used in which a fuel absorbent, such as activated carbon, is filled in a container, and is capable of absorbing and storing a vaporized fuel generated in the fuel tank 17. A purge conduit 52 is provided to the canister 50, and extends from the opposite side of the port communicating with the fuel tank 17. A downstream end portion of the purge conduit 52 is connected to the purge joint 51. A purge valve 53 opening during the operation of the engine 14 is provided halfway the purge conduit 52.

Next, an operation of the embodiment will be described below.

When the engine 14 of the riding-type mower 10 is not operated, the purge valve 53 is closed. In this state, when a vaporized fuel is generated in the fuel tank 17, the vaporized fuel is charged in the canister 50 and absorbed by the fuel absorbent inside the canister 50.

During the operation of the riding-type mower 10, a large amount of dust is stirred up by the cutter 22 in mowing. The engine 14 is operated under such a condition, when an intake negative pressure of the engine 14 acts on the air cleaner 31 through the intake duct 42, the outside air flows into the pre-purification chamber 45 through the air-inlet pipe 38. In this event, since the air-inlet pipe 38 extends in the tangential direction of the cylindrical case body 33, the air that has passed through the air-inlet pipe 38 causes a swirling flow inside the pre-purification chamber 45, so that dust contained in the swirling air is centrifugally separated. The air, from which the dust has been separated in this way, passes through the cleaner element 43 so as to be further filtered. The air then passes through the post-purification chamber 46, the air-outlet pipe 39, and the intake duct 42, and is taken into the engine 14. As described above, since the cleaner element 43 filters air from which dust has been centrifugally separated in the pre-purification chamber 45, the load on the cleaner element 43 due to the filtering operation is small, and clogging of dust is unlikely to occur therein. Moreover, the air cleaner 31 is mounted on the engine hood 30 on which the amount of dust is relatively small. Accordingly, the load on the cleaner element 43 due to the filtering operation is further alleviated, so that the service life of the cleaner element 43 can be improved.

During the operation of the engine 14 as described above, the purge valve 53 is opened. Accordingly, the intake negative pressure, which acts on the post-purification chamber 46 of the air cleaner 31, of the engine 14 acts also on the purge joint 51 opening to the post-purification chamber 46. The absorbed fuel is removed from the fuel absorbent in the canister 50 by the action of the negative pressure, is then sucked into the post-purification chamber 46 through the purge conduit 52 and the purge joint 51. The fuel thus sucked is taken into the engine 14 together with the air subjected to the filtering operation so as to be combusted therein.

Meanwhile, the purge joint 51 connecting the purge conduit 52 is provided to a portion, facing the post-purification chamber 46, of the lid body 34 of the air cleaner 31. Accordingly, processing the vaporized fuel removed from the canister 50 is enabled only by performing a quite small number of processes, that is, by attaching the purge joint 51 to the lid body 34 of the conventional air cleaner 31. As a result, the vaporized fuel processing system can be provided at a low cost. In addition, it goes without saying that the clogging of dust is unlikely to occur in the purge joint 51 provided to the portion, facing the post-purification chamber 46, of the lid body 34. Even if such clogging occurs, the purge joint 51 can be easily cleaned up from the inner side thereof only by detaching the lid body 34.

Although the embodiment of the present invention has been described so far, various modifications in design may be made on the present invention without departing from the scope of the present invention. For example, the present invention may be applied to tillers and mowers for farming gardening use other than riding-type mowers, and to engine generators used in construction sites, etc.

What is claimed is:

1. A vaporized fuel processing device in a work machine in which an engine and a fuel tank for the engine are mounted on a machine body, an air cleaner is mounted outside the machine body, the air cleaner comprises a cleaner case and a cleaner element, the cleaner case including a cylindrical case body and a lid body, the case body including an air-inlet pipe on an outer periphery thereof and an air-outlet pipe at one of opposite ends thereof and having the other end thereof open, the lid body being mounted on the other end of the case body, the cleaner element being housed in the cleaner case and dividing the inside of the cleaner case into a pre-purification chamber communicating with the air-inlet pipe and a post-purification chamber communicating with the air-outlet pipe, and the air-outlet pipe is connected to an intake system of the engine with an intake duct interposed therebetween, the vaporized fuel processing device comprising:

a canister attached to one of the fuel tank and the machine body, said canister absorbs a vaporized fuel generated in the fuel tank;

a purge joint attached to the lid body of the air cleaner, said purge joint communicates with the post-purification chamber; and a purge conduit which extends from the canister and connects to the purge joint.

2. The vaporized fuel processing device according to claim 1, further comprising:

a purge valve disposed inside the purge conduit, wherein said purge valve is opened when the engine is turned on, and said purge valve is closed when the engine is turned off.

3. The vaporized fuel processing device according to claim 1, wherein the purge joint faces the post-purification chamber.

4. The vaporized fuel processing device according to claim 1, further comprising a fuel absorbent disposed inside the canister.

5. The vaporized fuel processing device according to claim 1, wherein the purge joint is welded to an outside surface of the lid body.

6. The vaporized fuel processing device according to claim 1, wherein the work machine is a mower.

7. The vaporized fuel processing device according to claim 1, wherein the work machine is a generator.

* * * * *